US011007776B2

(12) United States Patent
Yamasaki

(10) Patent No.: US 11,007,776 B2
(45) Date of Patent: May 18, 2021

(54) PRINTER AND PRINTING METHOD

(71) Applicant: CASIO COMPUTER CO., LTD., Tokyo (JP)

(72) Inventor: Shuichi Yamasaki, Fussa (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 16/828,331

(22) Filed: Mar. 24, 2020

(65) Prior Publication Data

US 2020/0307181 A1 Oct. 1, 2020

(30) Foreign Application Priority Data

Mar. 25, 2019 (JP) ..... 2019-056922

(51) Int. Cl.
*B41J 2/045* (2006.01)
*B41J 29/393* (2006.01)

(52) U.S. Cl.
CPC ..... *B41J 2/04526* (2013.01); *B41J 2/04551* (2013.01); *B41J 29/393* (2013.01)

(58) Field of Classification Search
CPC ... B41J 2/04526; B41J 2/04551; B41J 29/393
See application file for complete search history.

(56) References Cited

U.S. PATENT DOCUMENTS

2005/0052487 A1* 3/2005 Yamasaki ..... B41J 29/393 347/19
2019/0009561 A1* 1/2019 Mukoyama ..... B41J 2/21

FOREIGN PATENT DOCUMENTS

JP 2001-2531 A 1/2001

* cited by examiner

*Primary Examiner* — Lamson D Nguyen
(74) *Attorney, Agent, or Firm* — Fitch, Even, Tabin & Flannery LLP

(57) ABSTRACT

A printer includes a print head and a processor. The print head ejects ink from nozzles to a printing medium while moving in a first direction, and also moves in a second direction intersecting with the first direction by a moving amount that is a dimension in the second direction of each of blocks into which the nozzles are divided in the second direction. Based on a position of the printing medium and the dimension, the processor determines whether to perform printing in a first mode or a second mode. A printing start position in the second direction of the print head is set such that a position in the second direction of one of boundaries between mutually adjacent blocks coincides, in the first mode, with a position of a back end of a printing region, and in the second mode, with a position of a front end of the printing region.

6 Claims, 11 Drawing Sheets

FIG.10

| TYPE OF MODE | PRINTING START POSITION IN DIRECTION ALONG Y-AXIS | SUBSTANTIAL PRINTING REGION WHEN DIMENSION OF PRINTING REGION IS NOT INTEGRAL MULTIPLE OF SENDING LENGTH |
|---|---|---|
| FIRST MODE | POSITION WITH WHICH BOUNDARY BETWEEN BLOCKS OF NOZZLE SURFACE COINCIDES WITH FAR-SIDE END OF PRINTING REGION | INCLUDE NO-DATA REGION IN FRONT OF PRINTING REGION |
| SECOND MODE | POSITION WITH WHICH BOUNDARY BETWEEN BLOCKS OF NOZZLE SURFACE COINCIDES WITH NEAR-SIDE END OF PRINTING REGION | INCLUDE NO-DATA REGION BEHIND PRINTING REGION |

FIG.11

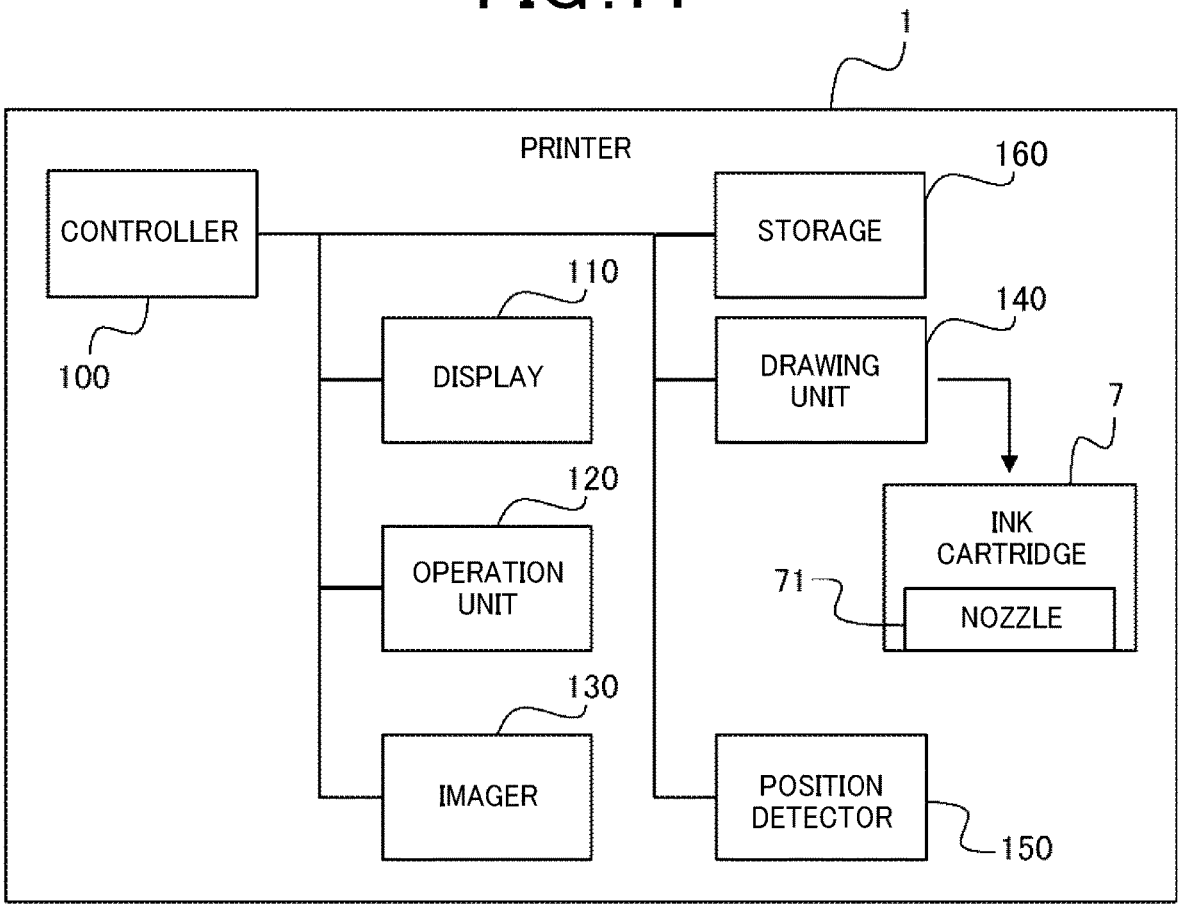

PRINTER AND PRINTING METHOD

CROSS-REFERENCE TO RELATED APPLICATIONS

This application is based upon and claims the benefit of priority from the prior Japanese Patent Application No. 2019-056922, filed Mar. 25, 2019, the entire contents of which are incorporated herein by reference.

BACKGROUND OF THE INVENTION

1. Field of the Invention

The present disclosure relates to a printer and a printing method.

2. Description of the Related Art

As one of inkjet printers, there is known, as disclosed in JP 2001-2531 A, a printer that performs printing on a printing medium while moving nozzles. This type of printer may perform printing on the entire printing medium by repeating a first operation of ejecting ink from nozzles to the printing medium while moving the nozzles in a first direction and a second operation of moving the nozzles in a second direction that is orthogonal to the first direction.

The abovementioned type of printer may employ a printing system called singling system. The singling system is a system in which nozzles are divided into blocks in the second direction, and printing is performed with the nozzles that are moved in the second direction by a dimension of one block in the second direction per second operation. In the singling system, printing on a small region of a printing region is completed by performing printing multiple times with different blocks of nozzles. This can reduce influence of, for example, nozzle clogging, and achieve high-quality printing.

SUMMARY OF THE INVENTION

However, in the singling system, when printing is performed on the vicinities of ends in the second direction of a printing region, some nozzles are outside the printing region. For this reason, printers employing the singling system has a large/long moving range of nozzles with respect to a printable region. This makes it difficult to miniaturize printers.

In view of the above circumstances, advantages of an aspect of the present invention include providing a technology that can make a moving range of nozzles with respect to a printable region small/short in a printer.

According to an aspect of the present invention, there is provided a printer including:

a print head that performs a first operation of ejecting ink from nozzles to a printing medium while moving in a first direction and a second operation of moving in a second direction intersecting with the first direction by a moving amount that is a block dimension in the second direction of each of blocks into which the nozzles are divided in the second direction; and a processor that, based on a position of the printing medium and the block dimension in the second direction, determines whether to perform printing on the printing medium in a first mode or a second mode, wherein the first mode is a mode in which a printing start position in the second direction of the print head is set such that a position in the second direction of one of boundaries between mutually adjacent blocks among the blocks coincides with a position of a back end of a printing region, and the second mode is a mode in which the printing start position of the print head is set such that a position of one of the boundaries coincides with a position of a front end of the printing region.

According to another aspect of the present invention, there is provided a printer including:

a print head that performs a first operation of ejecting ink from nozzles to a printing medium while moving in a first direction and a second operation of moving in a second direction intersecting with the first direction by a moving amount that is a block dimension in the second direction of each of blocks into which the nozzles are divided in the second direction; and a processor that, based on a position of the printing medium, a dimension of the printing medium in the second direction, and a printable region, determines whether to perform printing on the printing medium in a first mode or a second mode, wherein the first mode is a mode in which a printing start position in the second direction of the print head is set such that a position in the second direction of one of boundaries between mutually adjacent blocks among the blocks coincides with a position of a back end of a printing region, and the second mode is a mode in which the printing start position of the print head is set such that a position of one of the boundaries coincides with a position of a front end of the printing region.

According to another aspect of the present invention, there is provided a printing method including:

before causing a print head to perform a first operation of ejecting ink from nozzles to a printing medium while moving in a first direction and a second operation of moving in a second direction intersecting with the first direction by a moving amount that is a block dimension in the second direction of each of blocks into which the nozzles are divided in the second direction, based on a position of the printing medium and the block dimension in the second direction, determining whether to perform printing on the printing medium in a first mode or a second mode, wherein the first mode is a mode in which a printing start position in the second direction of the print head is set such that a position in the second direction of one of boundaries between mutually adjacent blocks among the blocks coincides with a position of a back end of a printing region, and the second mode is a mode in which the printing start position of the print head is set such that a position of one of the boundaries coincides with a position of a front end of the printing region.

According to another aspect of the present invention, there is provided a printing method including:

before causing a print head to perform a first operation of ejecting ink from nozzles to a printing medium while moving in a first direction and a second operation of moving in a second direction intersecting with the first direction by a moving amount that is a block dimension in the second direction of each of blocks into which the nozzles are divided in the second direction, based on a position of the printing medium, a dimension of the printing medium in the second direction, and a printable region, determining whether to perform printing on the printing medium in a first mode or a second mode, wherein the first mode is a mode in which a printing start position in the second direction of the print head is set such that a position in the second direction of one of boundaries between mutually adjacent blocks among the blocks coincides with a position of a back end of a printing region, and the second mode is a mode in which the printing start position of the print head is set such that a position of one of the boundaries coincides with a position of a front end of the printing region.

BRIEF DESCRIPTION OF THE DRAWINGS

The accompanying drawings, which are incorporated in and constitute a part of the specification, illustrate embodiments, and together with the general description given above and the detailed description of the embodiments given below, serve to explain the principles of the present invention, wherein:

FIG. 10 is a diagram to explain types of printing mode in the printer according to an embodiment(s);

FIG. 11 is a block diagram showing functional configuration of the printer according to an embodiment(s);

DETAILED DESCRIPTION OF THE PREFERRED EMBODIMENTS

Figure 1:
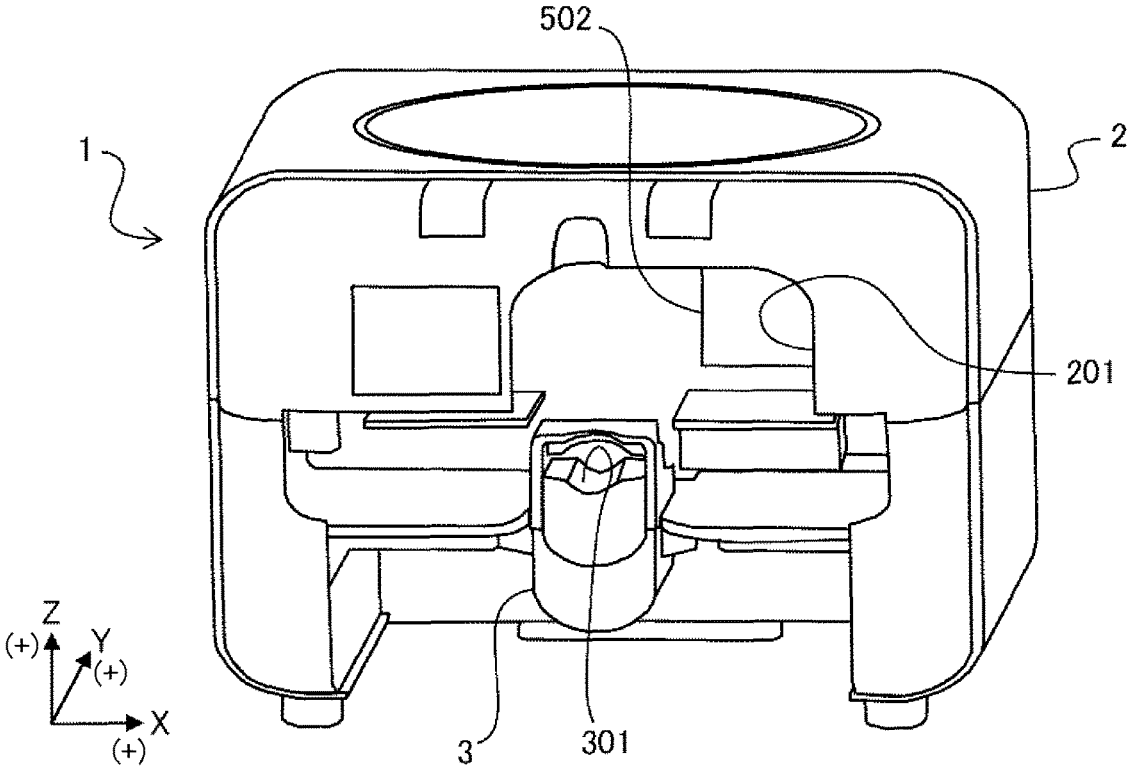
FIG. 1 is a perspective view of a printer according to an embodiment(s)
Figure 2:
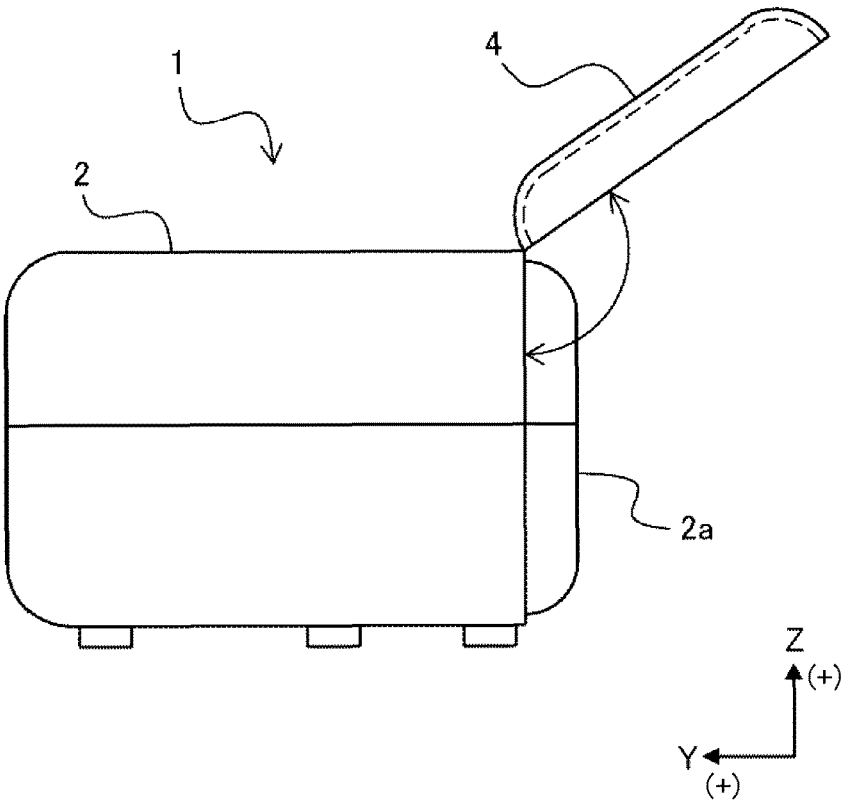
FIG. 2 is a lateral view of the printer.
Figure 3:
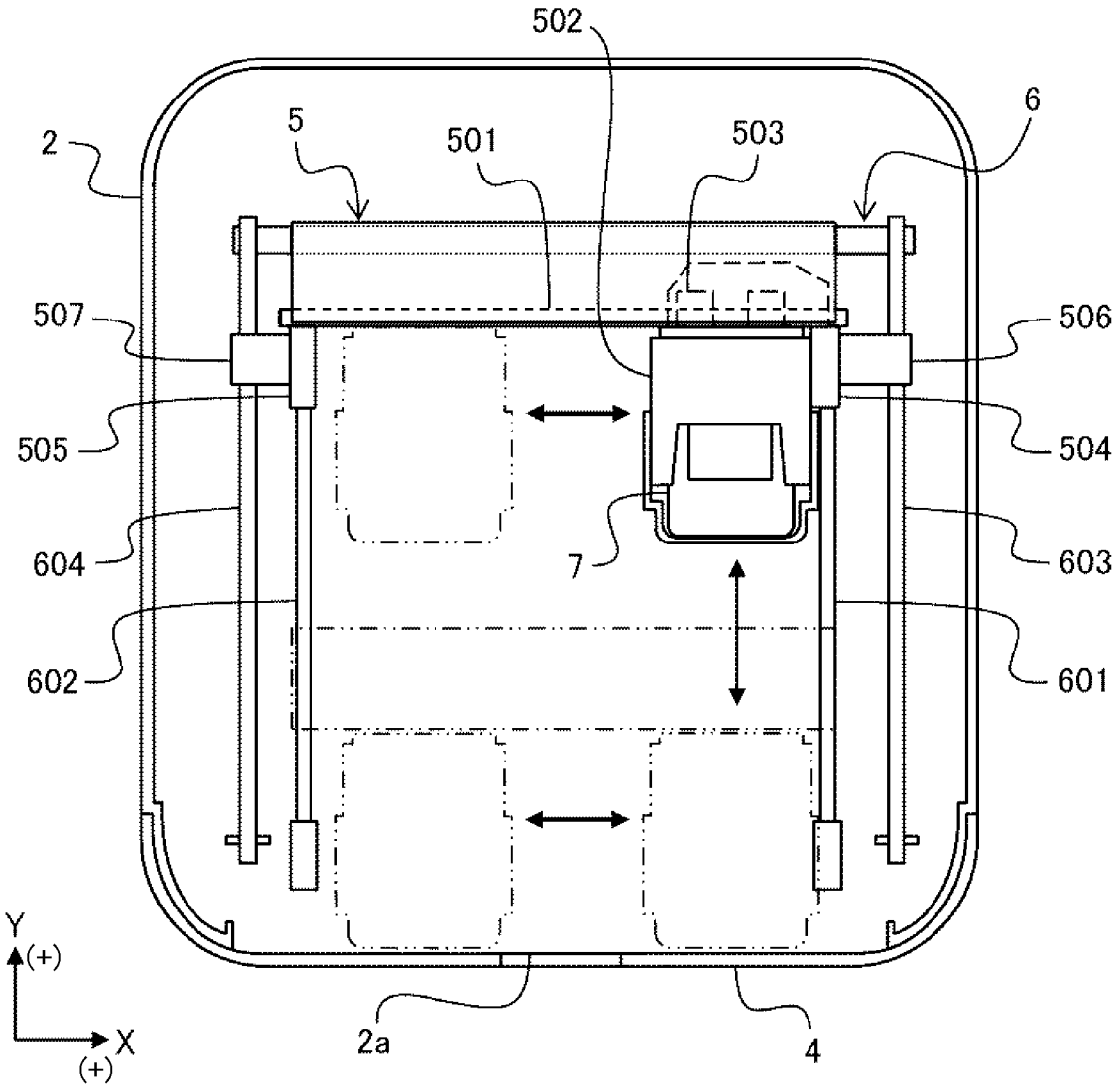
FIG. 3 shows the main mechanism in the printer.

First, with reference to FIG. 1 to FIG. 3, configuration of a printer according to an embodiment(s) will be described. FIG. 1 is a perspective view of a printer 1. FIG. 2 is a lateral view of the printer 1. FIG. 3 shows the main mechanism in the printer 1. The printer 1 has a cover 4 (shown in FIG. 2, etc.) with which a finger fixing part 3, which is described below, is covered when the printer 1 is not in use. Directions along X-axis, Y-axis, and Z-axis in FIG. 1 are orthogonal to one another. Regarding each of the directions along the respective axes in FIG. 1, a direction pointed by an arrow is defined as a positive (+) direction, and a direction opposite to the direction pointed by the arrow is defined as a negative (−) direction. The direction along the Y-axis and the direction along the Z-axis in FIG. 2 coincide with the direction along the Y-axis and the direction along the Z-axis in FIG. 1, respectively. Also, the direction along the X-axis and the direction along the Y-axis in FIG. 3 coincide with the direction along the X-axis and the direction along the Y-axis in FIG. 1, respectively.

The printer 1 shown in FIG. 1 to FIG. 3 is an example of an inkjet printer; or to be more specific, a nail printer that performs printing on a predetermined region of a printing medium (as a printing target), such as a nail of a hand. The printer 1 has an opening 201 formed in a lateral surface (hereinafter "front surface") 2*a* of all lateral surfaces of a case 2. In the opening 201 of the case 2, the finger fixing part 3 having an insertion opening 301 into which a finger as the printing target is inserted is provided. The opening 201 of the front surface 2*a* of the case 2 is shaped such that, through the opening 201, an ink cartridge is attachable to and detachable from a holder 502 arranged in the case 2, for example. To the case 2, the cover 4 is attached. By the cover 4, the opening 201 of the front surface 2*a* is covered and uncovered. The cover 4 is attached to the upper end of the front surface 2*a* of the case 2 with a hinge (not shown).

As shown in FIG. 3, the case 2 houses a first drive unit 5 (first carriage) and a second drive unit 6 (second carriage). The case 2 also houses various electric components, various mechanical components of various mechanisms, and so forth, which are not shown.

The first drive unit 5 holds a print head 7 such that the print head 7 is movable along (in) a first direction. The second drive unit 6 holds the first drive unit 5 such that the first drive unit 5 is movable along (in) a second direction that is orthogonal to the first direction. In this embodiment, the first direction is the direction along the X-axis, and the second direction is the direction along the Y-axis. That is, the front surface 2*a* of the case 2 is one of lateral surfaces serving as end surfaces in the direction along the Y-axis. As shown in FIG. 3, the print head 7 is a type integrated with an ink cartridge and is held by the holder 502, but may be a type separate from an ink cartridge. The print head 7 has nozzles arranged on its lower surface for ejecting liquid droplets with the inkjet system.

The first drive unit 5 has a guide shaft 501 the axial direction of which is the first direction. The holder 502 holding the print head 7 is attached to the guide shaft 501 with an attaching part 503 so as to be movable along the axial direction of the guide shaft 501 (i.e. direction along the X-axis). Although not shown, the first drive unit 5 includes a first motor, such as a DC motor, and a conversion mechanism that converts rotation of the first motor into movement in the first direction. The holder 502 is connected to a belt of the conversion mechanism, and moves along the first direction by the rotation of the first motor. The holder 502 and the print head 7 are movable, for example, from a position indicated by a solid line in FIG. 3 as their rightmost position to a position indicated by a two-dot chain line in FIG. 3 as their leftmost position. Although not shown either, the first drive unit 5 has an encoder used for measuring the position of the holder 502 (print head 7) in the first direction.

The second drive unit 6 has guide shafts 601, 602 the axial direction of which is the second direction. The first drive unit 5 is attached to the guide shafts 601, 602 with attaching parts 504, 505 so as to be movable along the axial direction of the guide shafts 601, 602 (i.e. direction along the Y-axis). Although not shown, the second drive unit 6 has a second motor, such as a stepping motor, and a conversion mechanism that converts rotation of the second motor into movement in the second direction. The first drive unit 5 is connected to belts 603, 604 of the conversion mechanism by attaching parts 506, 507, and moves along the second direction by the rotation of the second motor. The first drive unit 5 is movable to a position indicated by a two-dot chain line in FIG. 3 as its foremost position.

The position of the holder 502 of the first drive unit 5 and the print head 7 indicated by the solid line in FIG. 3, namely the position thereof farthermost from the front surface 2*a* of the case 2 and rightmost, is a position called, for example, home position where the holder 502 is located when the printer 1 is not powered or is in a standby state in which the printer 1 performs neither printing nor cleaning/maintenance. When the holder 502 is at the home position, the nozzles of the print head 7 held by the holder 502 are covered with a cap (not shown) provided in the case 2. This prevents the nozzles from drying and ink from evaporating.

When performing printing, after moving the first drive unit 5 in the second direction toward the front surface 2*a* of the case 2 (negative direction of the Y-axis) until it reaches a printing start position, the printer 1 repeatedly (or alternatively) performs a first operation of moving the holder 502 (print head 7) in the first direction (positive direction or negative direction of the X-axis) and a second operation of moving the first drive unit 5 (print head 7) in the second direction toward the front surface 2*a* of the case 2 (negative direction of the Y-axis) by a predetermined distance. In the first operation, the printer 1 ejects ink from the nozzles of the print head 7 to a nail as the printing target, thereby performing printing on the nail, while the nozzles are passing over the nail.

The printer 1 can perform purging and wiping at a position(s) on the left side of the home position of the holder 502 (left rear in FIG. 3). The purging is a process of ejecting ink not used for printing, from the nozzles of the print head 7. Wiping is a process of bringing the tip of the nozzles into contact with a wiping part, thereby removing ink, dust, or the like present on the tip thereof.

As described above, the printer 1 of this embodiment performs printing by repeating the first operation of ejecting ink to a recording medium while moving the print head 7 in the first direction (direction along the X-axis) and the second operation of moving the print head 7 in the second direction (direction along the Y-axis). More specifically, the printer 1 of this embodiment performs printing by controlling the first operation and the second operation in accordance with a printing system called singling system.

Figure 4:
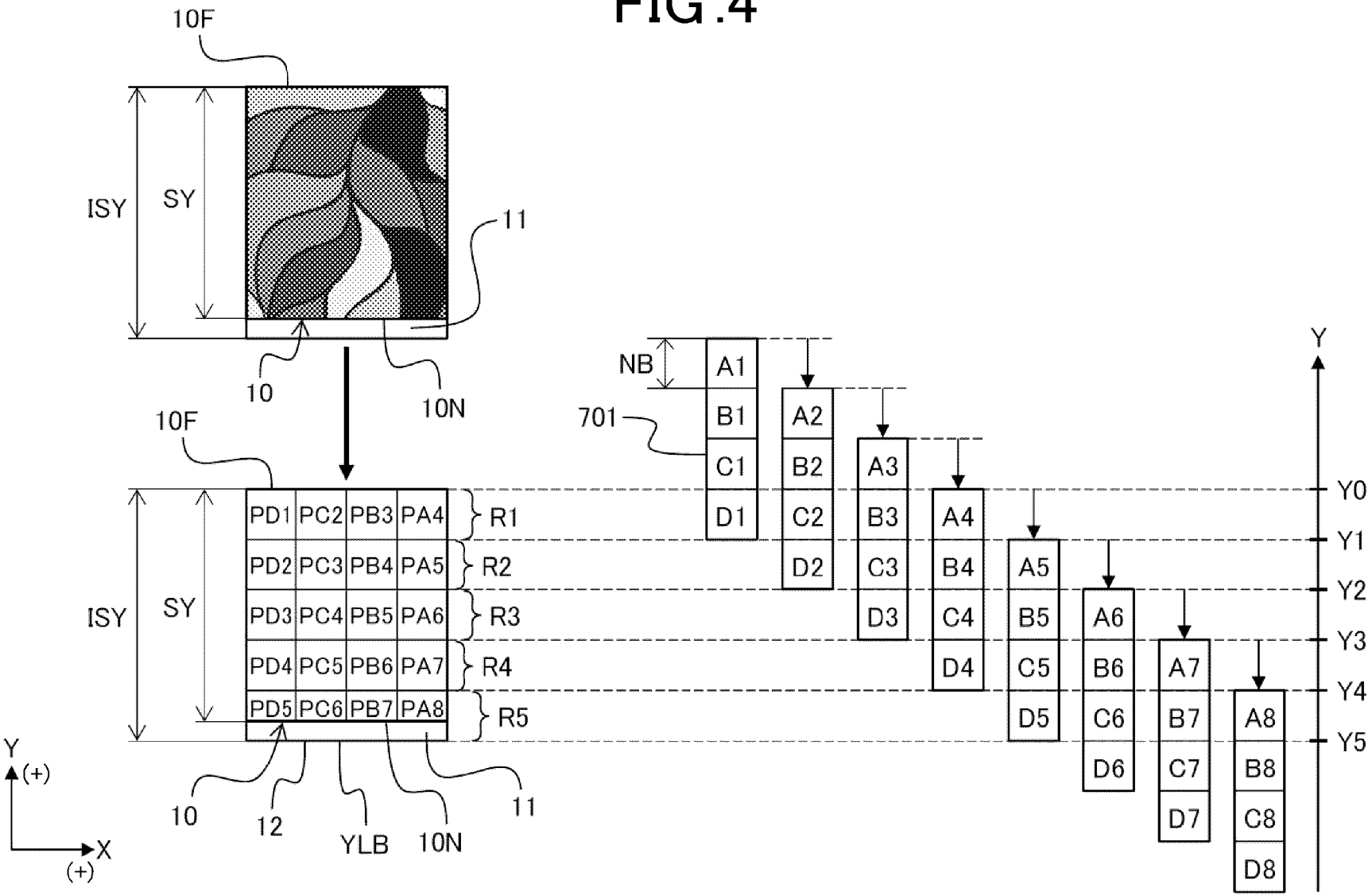
FIG. 4 is a diagram to explain a printing method in accordance with a singling system.

FIG. 4 is a diagram to explain a printing method in accordance with the singling system. The direction along the X-axis and the direction along the Y-axis in FIG. 4 coincide with the direction along the X-axis and the direction along the Y-axis in FIG. 3, respectively.

In order to perform printing, the printer 1 of this embodiment determines a printing region 10, which is shown in FIG. 4 as an example, on the basis of the size (dimensions) and position of the printing target (e.g. nail). Then, the printer 1 adjusts nail design data (drawing data), which is selected by a user or the like of the printer 1, on the basis of the size of the printing region 10 such that the nail design data fits in the printing region 10. A dimension SY of the printing region 10 in the direction along the Y-axis is a dimension of the nail as the printing target in the direction along the Y-axis (second direction). A nozzle group 701 of the print head 7 is composed of at least one line of nozzles as ejection holes arranged in the direction along the Y-axis.

In printing with the singling system, the nozzle group 701 of the print head 7 is divided into blocks in the direction along the Y-axis, and a moving amount (sending amount) of the print head 7 per second operation is made to coincide with a dimension of one block in the direction along the Y-axis. FIG. 4 shows a case where the nozzle group 701 is equally divided into four blocks A to D. The block D, the block C, the block B, and the block A are arranged in this order from a near side (front side) near to the front surface 2*a* of the case 2. Where a dimension of each block (hereinafter "block dimension") in the direction along the Y-axis is represented by NB, a dimension of an ejection region of the nozzle group 701 in the direction along the Y-axis is four times as long as the block dimension NB, and the moving amount of the print head 7 per second operation is made to coincide with the block dimension NB. The four blocks A, B, C, and D of the nozzle group 701 that are used in the $n^{th}$ first operation (where n is a positive integer) are defined as blocks An, Bn, Cn, and Dn, respectively.

When printing on the printing region 10 starts, the print head 7 moves from the home position toward the front surface 2*a* of the case 2 until it reaches the printing start position. If the second operation, which is performed by the printer 1, is an operation of moving the print head 7 in the direction along the Y axis toward (approaching) the front surface 2*a* of the case 2, the printing start position in the direction along the Y-axis is determined on the basis of, between ends 10F, 10N of the printing region 10 in the direction along the Y-axis, a position Y0 of the far-side end (back end) 10F far from the front surface 2*a* of the case 2. In this case, in the $1^{st}$ first operation, only nozzles of the block D1, which is nearest to the front surface 2*a* of the case 2 among the four blocks A1 to D1 of the nozzle group 701, perform printing (eject ink therefrom) on the printing region 10, and nozzles of the other blocks A1 to C1 of the nozzle group 701 do not perform printing. Thus, the printing start position in the direction along the Y-axis is determined, as shown in FIG. 4, such that the position of the boundary between the block D1 and its adjacent block C1 of the nozzle group 701 in the direction along the Y-axis is the same as the position Y0, which is the position of the far-side end 10F of the printing region 10. After moving to the printing start position, the print head 7 moves in the first direction. The print head 7 ejects ink from the block D1 of the nozzle group 701 to the nail, thereby performing printing on a sub-region PD1 of a partial region R1 (performing the $1^{st}$ printing on the partial region R1), while the block D1 is passing over the printing region 10. The partial region R1 is a region from the position Y0 to a position Y1 in the printing region 10. The position Y1 is nearer to the front surface 2*a* of the case 2 than the position Y0 is, by the block dimension NB (i.e. Y1=Y0−NB).

After the $1^{st}$ printing ($1^{st}$ first operation) on the partial region R1, the print head 7 moves in the direction along the Y-axis (moves forward) as the second operation by the block dimension NB. In this state, the print head 7 starts the $2^{nd}$ first operation. The position of the block D2 in the direction along the Y-axis is the same as the position of a partial region R2, which is a region in front of the partial region R1. That is, the position of the block D in the direction along the Y-axis has changed from the position thereof in the $1^{st}$ first operation, which is the same as the position of the partial region R1. Also, the position of the block C2 in the direction along the Y-axis is the same as that of the partial region R1. In the $2^{nd}$ first operation, the print head 7 ejects ink to a sub-region PC2 of the partial region R1 from the block C2, thereby performing printing thereon, and ejects ink to a sub-region PD2 of the partial region R2 from the block D2, thereby performing printing thereon. In the $3^{rd}$ first operation, the print head 7 ejects ink to a sub-region PB3 of the partial region R1 from the block B3, thereby performing printing thereon, ejects ink to a sub-region PC3 of the partial region R2 from the block C3, thereby performing printing thereon, and ejects ink to a sub-region PD3 of a partial region R3 from the block D3, thereby performing printing thereon. Thus, in the $n^{th}$ first operation, ink is ejected from the block An, the block Bn, the block Cn, and the block Dn to the sub-region PAn, the sub-region PBn, the sub-region PCn, and the sub-region PDn, respectively. Ink may be ejected to the entire printing region 10 or to part of the printing region 10, depending on a design or the like. The scanning directions of the print head 7 in the odd-numberth first operation and the even-numberth first operation may be directions 180° opposite to one another along the X-axis, or may both be the right-to-left direction or the left-to-right direction.

Repeating the second operation and the first operation allows the block D1, the block C2, the block B3, and the block A4 to pass over the sub-region PD1, the sub-region PC2, the sub-region PB3, and the sub-region PA4 of the partial region R1, respectively, one time. Thus, a region that usually receives one time of conventional printing without singling can receive up to four times of printing. That is, with the singling system in which the nozzle group 701 is divided into four blocks, printing on the partial region R1 can be completed by performing printing four times with four different blocks of the nozzle group 701. Similarly, printing on each of the other partial regions R2 to R5 can be completed by performing printing four times with four different blocks A to D. Thus, performing printing multiple times with different blocks of the nozzle group 701 to complete printing on one partial region can reduce influence of, for example, nozzle clogging, and achieve high-quality printing. For example, if one nozzle of the block C among the blocks A to D is clogged with ink, and printing on a certain partial region (e.g. partial region R3) is performed with the block C only, only this partial region is affected by the nozzle clogging and has a lateral stripe from end to end, and accordingly has a lower printing quality than the other partial regions. Meanwhile, in the case of the singling system, although all the partial regions R1 to R5 are affected by the nozzle clogging of the block C, they each have a sub-region on which printing is performed with the block C and accordingly each have a short lateral stripe. That is, influence of the nozzle clogging of the block C exerted on each of the partial regions R1 to R5 is significantly smaller than that exerted on a partial region on which printing is performed with the block C only. Also, difference between degrees of the influence exerted on the partial regions R1 to R5 is small. Thus, printing with the singling system can reduce difference in printing quality between partial regions, and improve printing quality of the entire printing region.

In printing with the singling system, depending on a dimension of a nail in the direction along the Y-axis or a dimension of a design in the direction along the Y-axis, as shown in FIG. 4, the dimension SY of the printing region 10 in the direction along the Y-axis may not be an integral multiple of the block dimension NB of the nozzle group 701. In such a case, for example, as shown in FIG. 4, the foremost partial region R5 of the printing region 10 (i.e. the partial region on which printing is completed last) includes a no-data region 11 for which no drawing data used for printing exists. That is, in the case shown in FIG. 4, a region having a dimension ISY (=5×NB) including the no-data region 11 (no-ink-ejected region) that exists in front of the printing region 10 is a substantial printing region 12. Hence, in the case shown in FIG. 4, in the first operation after the second operation, the foremost position that a near-side end (front end) of the print head 7 near to the front surface 2*a* of the case 2 can reach is not a position of, between the ends 10F, 10N of the printing region 10 in the direction along the Y-axis, the near-side end 10N near to the front surface 2*a* of the case 2, but a position where three blocks B8, C8, D8 protrude from a position YLB (=Y5) of a near-side end of the substantial printing region 12 near to the front surface 2*a* of the case 2.

Figure 5:
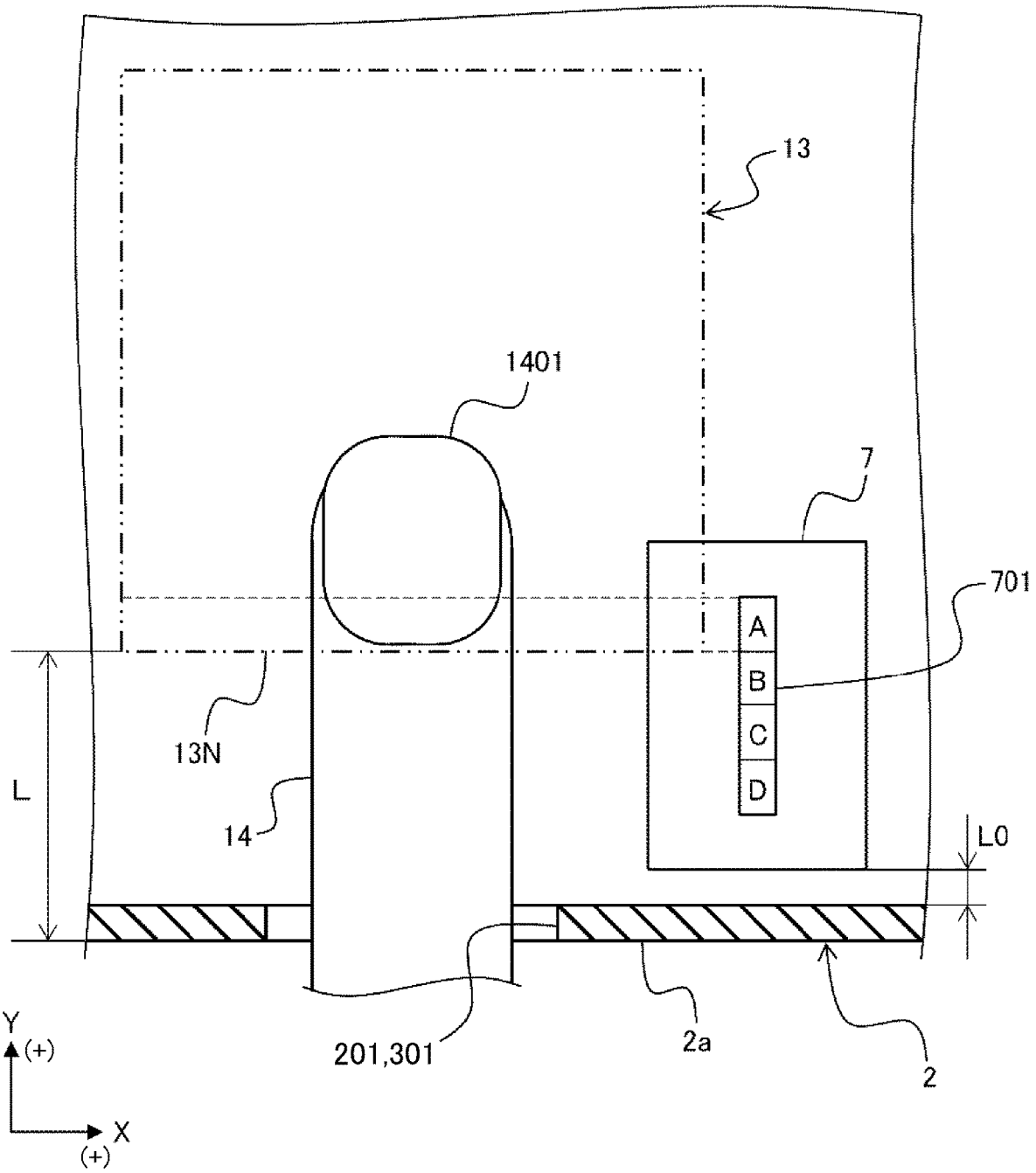
FIG. 5 is a diagram to explain restrictions on the position of a printable region.

FIG. 5 is a diagram to explain restrictions on the position of a printable region. The direction along the X-axis and the direction along the Y-axis in FIG. 5 coincide with the direction along the X-axis and the direction along the Y-axis in FIG. 3, respectively.

In the printer 1 of this embodiment, in order to prevent the print head 7 from contacting the case 2, the limit of movement of the print head 7 in the direction along the Y-axis toward the front surface 2*a* of the case 2 is, as shown in FIG. 5, a position separate from an inner wall of the front surface 2*a* of the case 2 by a distance L0. That is, the limit position of a near-side end 13N of a printable region 13 in the printer 1 is the position of the boundary between the block A and the block B of the nozzle group 701 at the time when the print head 7 reaches the abovementioned limit of movement in the direction along the Y-axis. In order for the printer 1 to perform printing on the entire nail, a finger 14 needs to be inserted from the opening 201 (insertion opening 301) such that the entire nail 1401 is placed inside the printable region 13. However, the little finger and the thumb are shorter than the other fingers, and further the length of the finger 14 differs between individuals. Meanwhile, in order to miniaturize the printer 1, it is preferable that a distance L from the front surface 2*a* of the case 2 to the near-side end 13N of the printable region 13 be as short as possible. However, depending on a printing design or the like, as shown in FIG. 4, the printer 1 employing the singling system may perform printing in a state in which the substantial printing region 12 includes the no-data region 11 in front of the printing region 10. Such a printer 1 needs to have a distance from the front surface 2*a* of the case 2 to the near-side end 13N of the printable region 13 longer than the distance L in FIG. 5.

Figure 6:
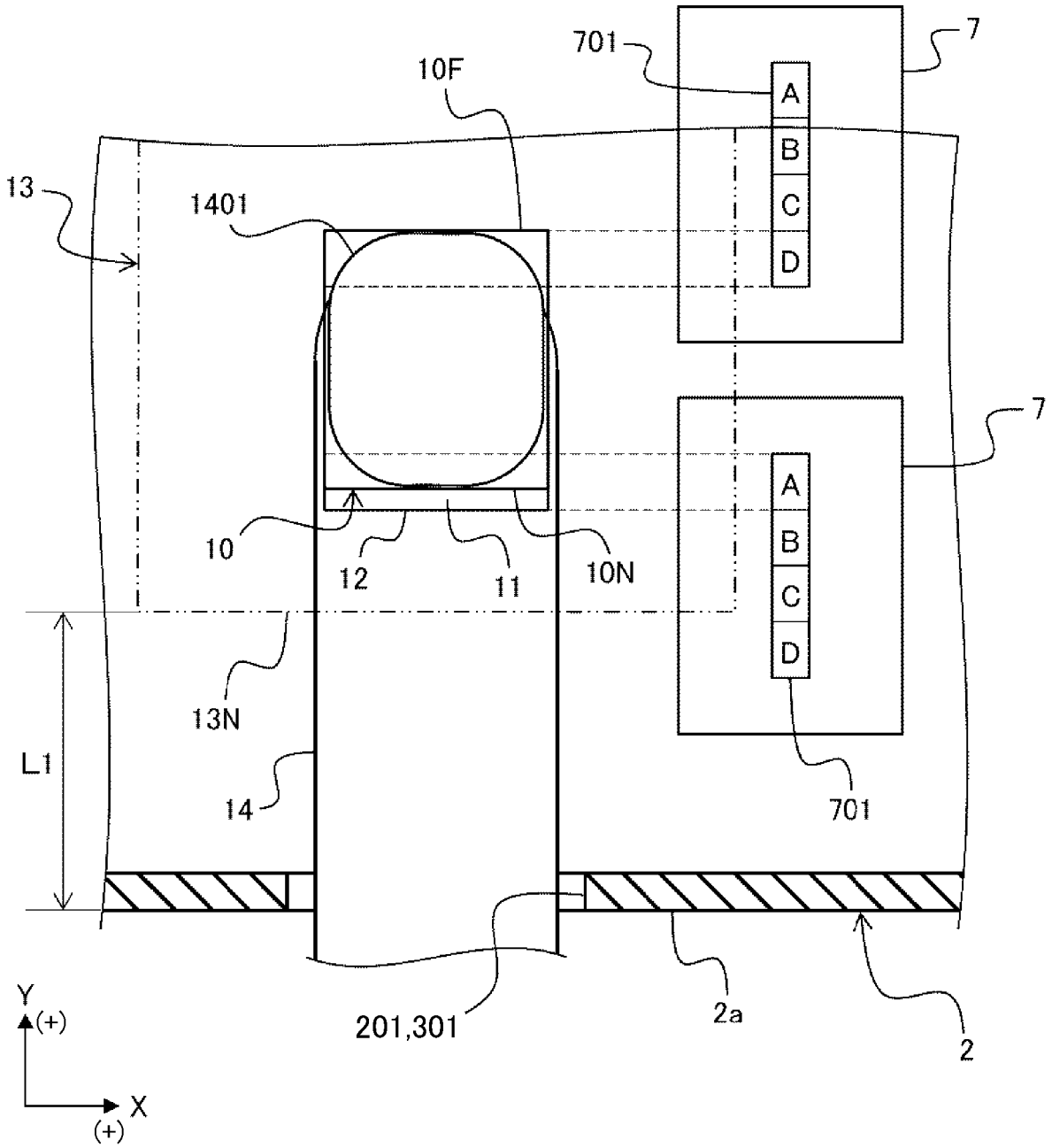
FIG. 6 shows a first example of a positional relationship between the printable region and a printing region.
Figure 7:
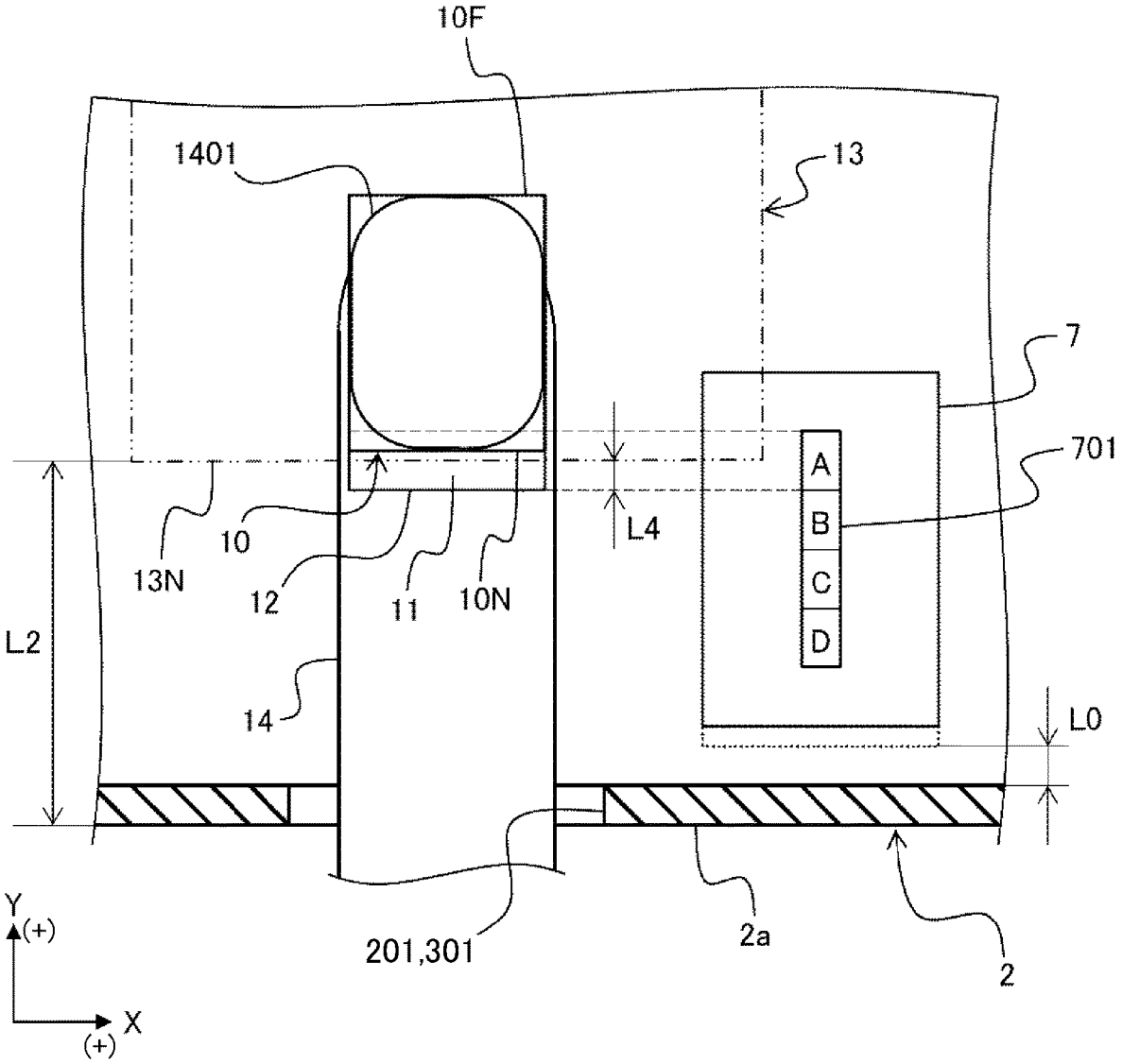
FIG. 7 shows a second example of the positional relationship between the printable region and the printing region.
Figure 8:
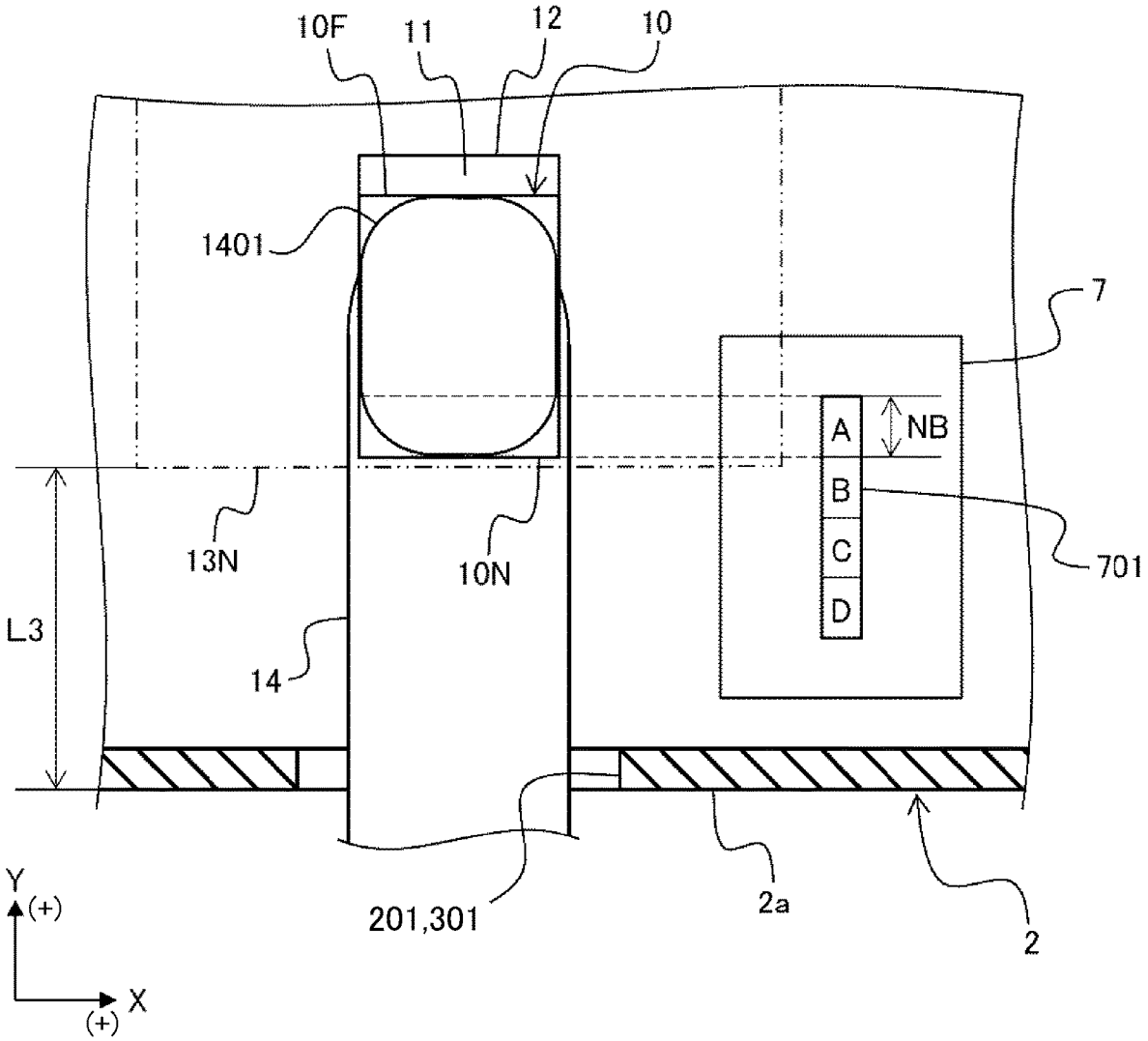
FIG. 8 shows a third example of the positional relationship between the printable region and the printing region.
Figure 9:
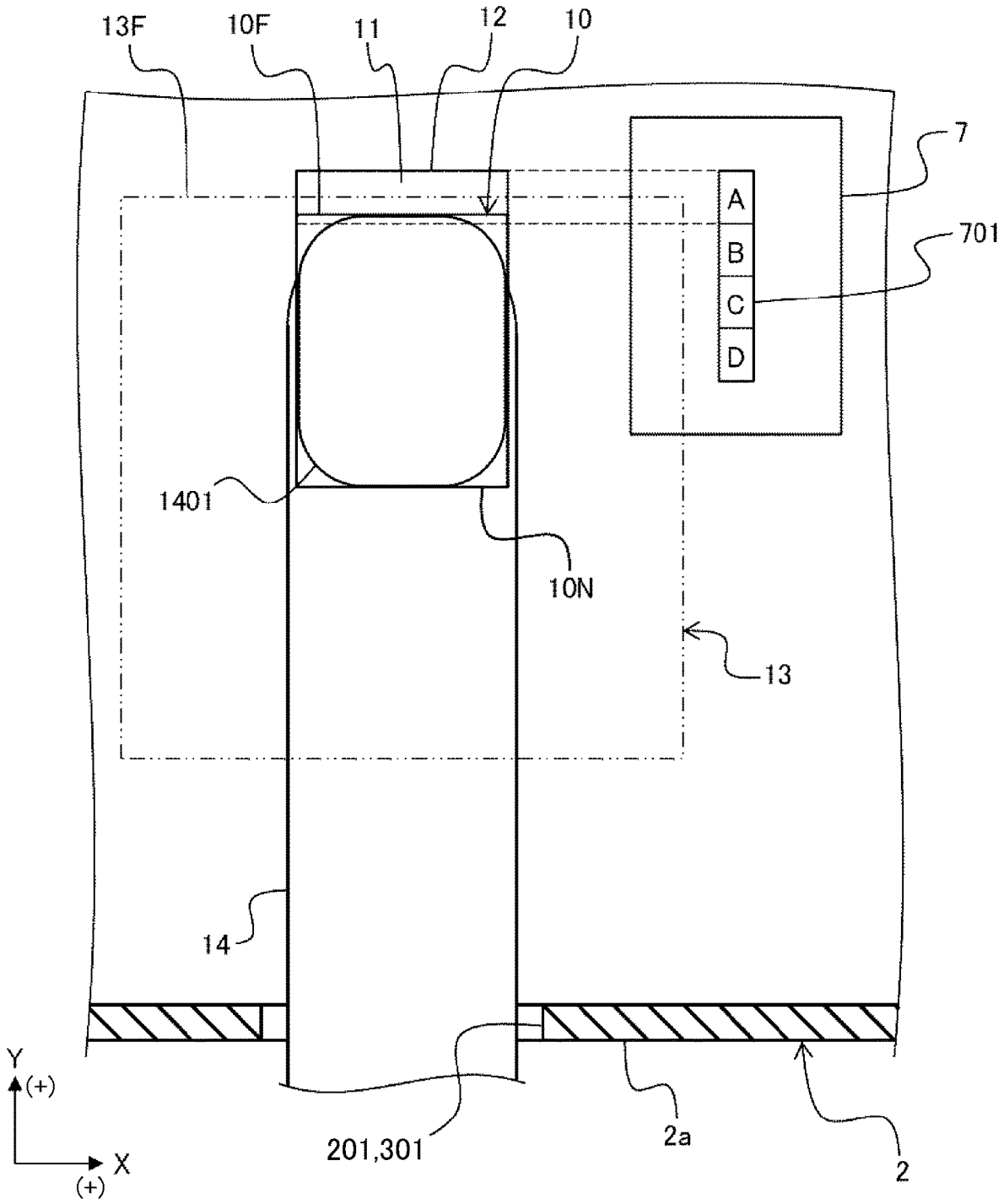
FIG. 9 shows a fourth example of the positional relationship between the printable region and the printing region.

FIG. 6 shows a first example of a positional relationship between a printable region and a printing region. FIG. 7 shows a second example of the positional relationship between the printable region and the printing region. FIG. 8 shows a third example of the positional relationship between the printable region and the printing region. FIG. 9 shows a fourth example of the positional relationship between the printable region and the printing region. The direction along the X-axis and the direction along the Y-axis in each of FIG. 6 to FIG. 9 coincide with the direction along the X-axis and the direction along the Y-axis in FIG. 5, respectively.

The printing region 10 shown in FIG. 6 is set at a position where a distance from the near-side end 10N of the printing region 10 to the near-side end 13N of the printable region 13 is longer than the block dimension NB of the nozzle group 701. When the dimension SY of the printing region 10 in the direction along the Y-axis is not an integral multiple of the block dimension NB, and printing starts with, as the printing start position, a position with which the position of the boundary between the block D and the block C coincides with the position of the far-side end 10F of the printing region 10, printing on the vicinity of the near-side end 10N of the printing region 10 is printing on a partial region including the no-data region 11 in front of the printing region 10.

In the case shown in FIG. 6, the entire substantial printing region 12 including the no-data region 11 is inside the printable region 13. Hence, at the end of printing, the print head 7 is positioned such that the boundary between the block A and the block B is behind the near-side end 13N of the printable region 13. This enables printing on the entire printing region 10 although a distance L1 from the front surface 2*a* of the case 2 to the near-side end 13N of the printable region 13 in FIG. 6 is the same as the distance L in FIG. 5.

However, as mentioned above, the length of a finger differs between individuals. Hence, for example, as shown in FIG. 5, there may be a case where although the entire nail 1401 is inside the printable region 13, a distance from the root of the nail 1401 to the near-side end 13N of the printable region 13 is shorter than the block dimension NB. In such a case, for example, as shown in FIG. 7, the near-side end of the substantial printing region 12 may be outside the printable region 13 (toward the front surface 2*a* of the case 2). Even when part of the substantial printing region 12 is outside the printable region 13, printing can be performed on the entire printing region 10 as long as the entire printing region 10 is inside the printable region 13. However, when the near-side end of the substantial printing region 12 is in front of the near-side end 13N of the printable region 13 (toward the front surface 2*a* of the case 2), at the end of printing, the print head 7 is positioned such that the boundary between the block A and the block B deviates from the near-side end 13N of the printable region 13 by a distance L4 toward the front surface 2*a* of the case 2. Hence, a distance L2 from the front surface 2*a* of the case 2 to the near-side end 13N of the printable region 13 in FIG. 7, the distance L2 being set on the basis of the limit of movement of the print head 7 or the like, is longer than the distance L in FIG. 5. Thus, the printer 1 that performs printing in the state in which the substantial printing region 12 includes the no-data region 11 in front of the printing region 10 is given strict restrictions on its size, treatable length of a finger, and so forth.

When, as shown in FIG. 4, the dimension SY of the printing region 10 in the direction along the Y-axis, the dimension SY being set on the basis of image data or the like, is not an integral multiple of the block dimension NB of the nozzle group 701, as shown in FIG. 8, the printer 1 may make the position of the boundary between the block A and the block B coincide with the position of the near-side end 10N of the printing region 10 and perform printing. This printing method can be realized, for example, as follows: the printer 1 takes, as the printing start position, a position with which the position of the boundary between the block A and the block B coincides with the position of the near-side end 10N of the printing region 10, and moves the print head 7 from the front side to the back side of the printer 1 (in the direction along the Y-axis) in the second operation. Alternatively, the printing method can be realized, for example, as follows: the printer 1 takes, as the printing start position, a position that is behind the far-side end 10F of the printing region 10 and to which a distance from the near-side end 10N of the printing region 10 is an integral multiple of the block dimension NB, and moves the print head 7 from the back side to the front side of the printer 1 (in the direction along the Y-axis) in the second operation.

In such a printer 1, from the start to the end of printing, the boundary between the block A and the block B is never in front of the near-side end 13N of the printable region 13. Hence, a distance L3 from the front surface 2*a* of the case 2 to the near-side end 13N of the printable region 13 can be set to the shortest distance, which is the same as the distance L in FIG. 5.

However, when the substantial printing region 12 includes the no-data region 11 behind the printing region 10, as shown in FIG. 9, the far-side end of the substantial printing region 12 including the no-data region 11 may be outside the printable region 13. In this case, for example, the amount of nozzles protruding from the printable region 13 (the amount of protrusion of the nozzles or nozzle group 701) in the direction along the Y-axis (backward) at the time of printing with the block D only, which is performed immediately after printing starts or immediately before printing ends, is larger than that in the case where the substantial printing region 12 includes the no-data region 11 in front of the printing region 10. Hence, in this case, contrary to the above, a space for preventing the print head 7 from contacting other various components during printing is needed behind the printable region 13. This makes it difficult to miniaturize the printer 1.

In order to ease the restrictions due to the substantial printing region 12 including the no-data region 11 in front of or behind the printing region 10 as described above, the printer 1 of this embodiment switches the positional relationship between the printing region 10 and the no-data region 11 (printing mode) on the basis of the position of the printing region 10 in the printable region 13.

FIG. 10 is a diagram to explain the printing mode in the printer 1 according to an embodiment(s).

The printer 1 of this embodiment has a first mode and a second mode shown in FIG. 10 as the printing mode used in printing with the singling system.

The first mode is the printing mode described above with reference to FIG. 4 and FIG. 6. That is, in the case of printing in the first mode, the printing start position in the direction along the Y-axis is determined such that the position of a boundary between mutually adjacent blocks of the nozzle group 701 at the start or the end of printing coincides with the position of the far-side end 10F of the printing region 10. Hence, when the dimension SY of the printing region 10 in the direction along the Y-axis is not an integral multiple of the block dimension NB (i.e. the sending amount of the print head 7), and printing is performed in the first mode, the substantial printing region 12 includes the no-data region 11 in front of the printing region 10.

The second mode is the printing mode described above with reference to FIG. 8. That is, in the case of printing in the second mode, the printing start position in the direction along the Y-axis is determined such that the position of a boundary between mutually adjacent blocks of the nozzle group 701 at the start or the end of printing coincides with the position of the near-side end 10N of the printing region 10. Hence, when the dimension SY of the printing region 10 in the direction along the Y-axis is not an integral multiple of the block dimension NB (i.e. the sending amount of the print head 7), and printing is performed in the second mode, the substantial printing region 12 includes the no-data region 11 behind the printing region 10.

The printer 1 of this embodiment performs printing in the second mode when, for example, the distance from the near-side end 10N of the printing region 10 to the near-side end 13N of the printable region 13 is shorter than the sending amount of the print head 7 (i.e. the block dimension NB) in the second operation, and performs printing in the first mode when, for example, the distance from the near-side end 10N of the printing region 10 to the near-side end 13N of the printable region 13 is longer than the sending amount of the print head 7 (i.e. the block dimension NB) in the second operation. This can prevent the amount of the nozzle group 701 protruding from the printable region 13 from being large because even when the no-data region 11 exists adjacent to one of the near-side end 10N and the far-side end 10F of the printing region 10, a boundary between mutually adjacent blocks of the nozzle group 701 is aligned with the other. The printer 1 of this embodiment, which prints various images by switching the printing mode between the first mode and the second mode according to circumstances, has the overall moving range of nozzles in the direction along the Y-axis obtained by overlapping/placing the moving range thereof in the direction along the Y-axis in the first mode on the moving range thereof in the direction along the Y-axis in the second mode being shorter than the moving range of nozzles in the direction along the Y-axis in a printer that prints images in a conventional first mode only, and also being shorter than the moving range of nozzles in the direction along the Y-axis in a printer that prints images in a conventional second mode only.

FIG. 11 is a block diagram showing functional configuration of the printer 1 according to an embodiment(s).

As shown in FIG. 11, the printer 1 of this embodiment includes a controller 100 (processor), a display 110, an operation unit 120, an imager 130, a drawing unit 140, a position detector 150, and a storage 160.

The controller 100 controls operation of the printer 1. The controller 100 includes, for example, a processing circuit, such as a CPU (Central Processing Unit), and performs processes in accordance with data, such as programs, stored in a RAM (Random Access Memory), a ROM (Read Only Memory), and/or the like as the storage 160. The display 110 displays, for example, nail designs. The operation unit 120 is used, for example, for selecting a nail design. The imager 130 obtains an image of a finger (nail) inserted into the case 2. The drawing unit 140 includes, for example, the first drive unit 5 and the second drive unit 6, and controls ink ejection of nozzles 71 provided in the print head 7 to print (draw) a desired nail design. The position detector 150 includes, for example, an encoder and an origin sensor unit(s), and detects coordinates of the position(s) of the nozzles 71 (nozzle group 701) as counter values. In the printer 1 of this embodiment, for example, the controller 100 determines the printing region 10 on the basis of an image of a finger inside the printable region 13 obtained by the imager 130 and nail design data, and determines whether to perform printing in the first mode or the second mode.

Figure 12:
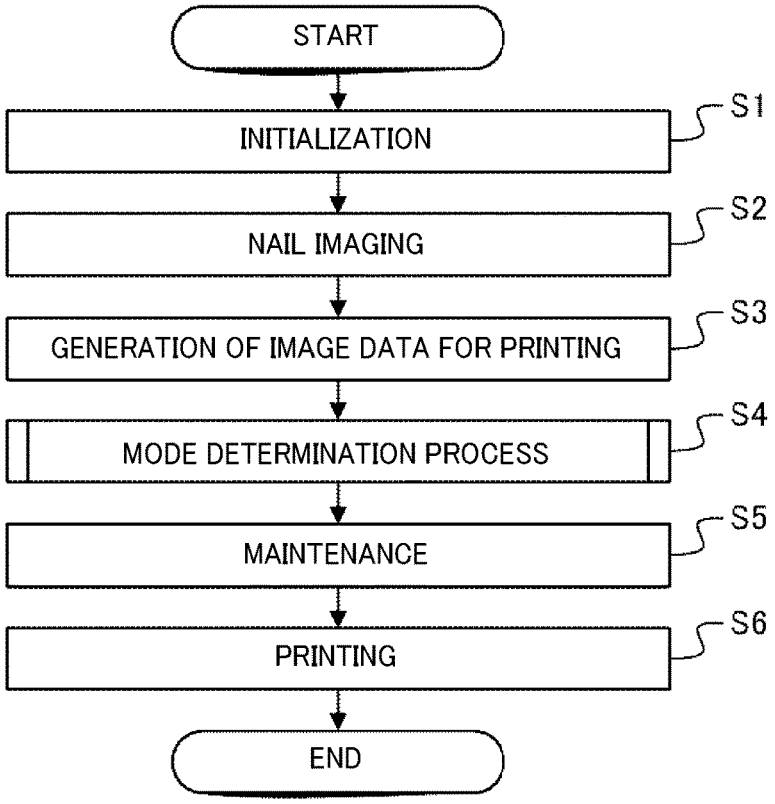
FIG. 12 is a flowchart to explain a process that is performed by the printer.

FIG. 12 is a flowchart to explain a process that is performed by the printer 1.

When powered, the printer 1 starts the process shown in FIG. 12. The printer 1 first performs initialization (Step S1). The printer 1 does not know where the nozzle group 701 of the print head 7 is immediately after powered. Hence, in order to detect the origin position, the controller 100 causes the drawing unit 140 to convey the print head 7, and detects the origin position on the basis of output of the position detector 150. After detecting the origin position, the controller 100 causes the drawing unit 140 to convey the print head 7 to the home position so that the nozzle group 701 is capped. This initialization is performed even if the nozzle group 701 of the print head 7 is at the home position immediately after the printer 1 is powered.

Next, when a user of the printer 1 selects a nail design, the printer 1 images a nail of the user (Step S2). The nail design may be obtained as nail design data through communications from an external device, such as a smartphone or a personal computer, in response to the nail design being selected, or may be stored in the storage 160 of the printer 1 as data. In this embodiment, the controller 100 outputs an imaging instruction to the imager 130 to cause the imager 130 to image a finger (nail) inserted into the finger fixing part 3 from the insertion hole 301. The nail design may be selected after the nail of the user is imaged.

After the imager 130 images the nail, the printer 1 generates image data for printing that is used for printing (drawing) the selected nail design on the nail (Step S3). In this embodiment, on the basis of the image of the nail obtained in Step S2, the controller 100 detects contours of the nail, and generates nail information including the size and the shape of the nail. Further, on the basis of the nail information, the controller 100 adjusts the nail design data, which has been selected by the user, by trimming off a part(s) corresponding to the outside of the contours of the nail, thereby generating the image data for printing.

After the controller 100 generates the image data for printing, the printer 1 performs a mode determination process (Step S4). In this embodiment, the controller 100 as a mode determiner determines whether to perform printing in the first mode or the second mode on the basis of the nail information and the image data for printing generated in Step S3.

After the controller 100 determines the printing mode, the printer 1 performs maintenance (Step S5). In this embodiment, the controller 100 causes the drawing unit 140 to convey the print head 7 to the wiping position and the purging position in this order, and performs wiping and purging at their respective positions. Thereafter, the controller 100 causes the drawing unit 140 to convey the print head 7 to the printing start position in accordance with the printing mode determined in the mode determination process. The drawing unit 140 determines the printing start position on the basis of the nail information generated in Step S3, the dimension SY in the direction along the Y-axis of the image data for printing generated in Step S3, the block dimension NB of the nozzles 71, and the printing mode (first mode or second mode) determined in Step S4.

Finally, the printer 1 prints the nail design on the nail (Step S6). In this embodiment, the controller 100 controls ink ejection of the nozzles 71 on the basis of the image data generated in Step S3, thereby printing the nail design on the nail of the finger placed in the printable region 13.

By performing the above process, the printer 1 can print a desired nail design on a nail, the desired nail design being selected by a user thereof.

Figure 13:
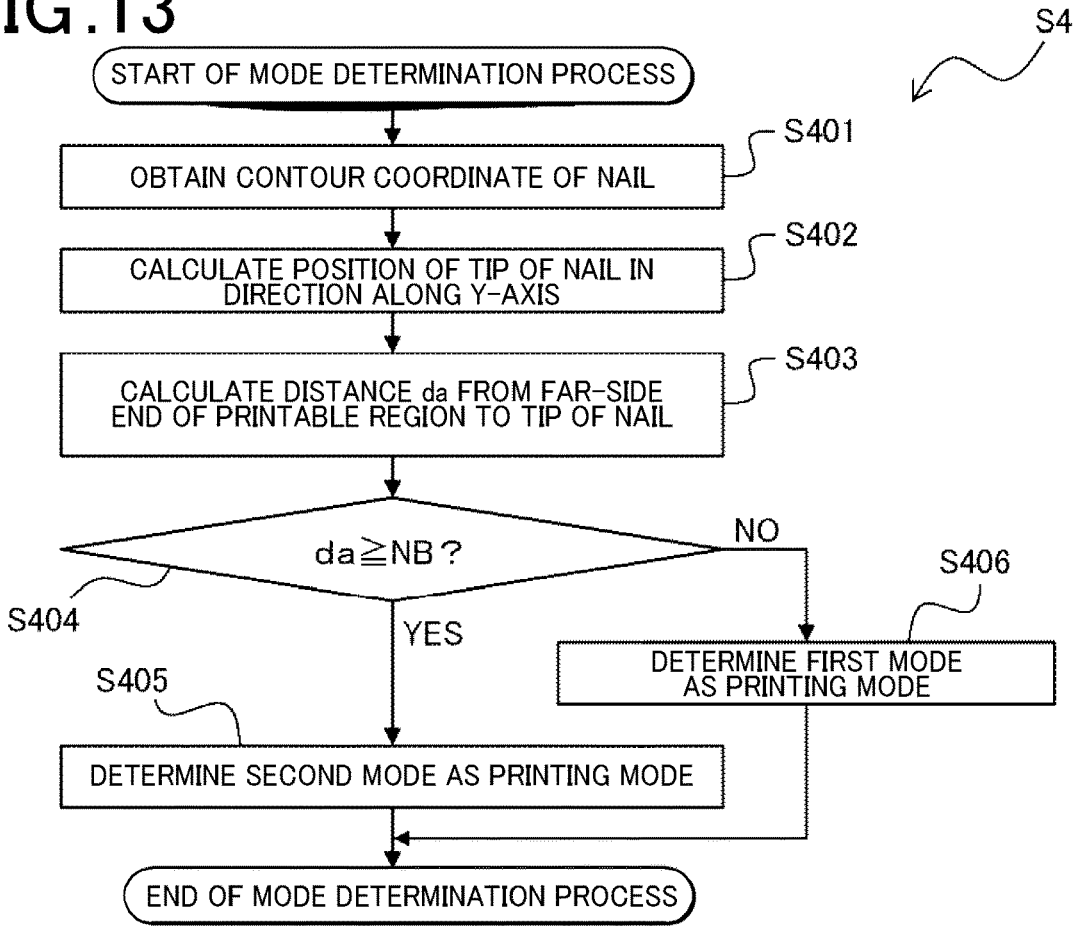
FIG. 13 is a flowchart to explain a first example of a mode determination process.

The printer 1 of this embodiment performs, as the mode determination process in Step S4, a process shown in FIG. 13, for example.

FIG. 13 is a flowchart to explain a first example of the mode determination process.

When starting the mode determination process, the controller 100 first obtains contour coordinates of the nail (Step S401). The controller 100 obtains contour coordinates of the nail included in the nail information generated by itself in Step S3. The contour coordinates of the nail may be X coordinate in the direction along the X-axis, Y coordinate in the direction along the Y-axis, and Z coordinate in the direction along the Z-axis, or may be the X coordinate and the Y coordinate only.

Next, the controller 100 calculates a position of the tip of the nail in the direction along the Y-axis from the contour coordinates of the nail (Step S402). In this example, on the basis of the contour coordinates of the nail, the controller 100 calculates coordinates of the backmost point of the contours in the direction along the Y-axis as the position of the tip of the nail.

Next, the controller 100 calculates a distance da from the far-side end 13F of the printable region 13 to the tip of the nail (Step S403), and determines whether or not the distance da is equal to or longer than the block dimension NB of the nozzle group 701 (Step S404). If da NB (Step S404; YES), the controller 100 determines the second mode as the printing mode (Step S405). If da<NB (Step S404; No), the controller 100 determines the first mode as the printing mode (Step S406). After determining the printing mode in Step S405 or Step S406, the controller 100 ends the mode determination process. After the mode determination process, the controller 100 notifies the drawing unit 140 of the printing mode determined in Step S4 together with a signal for maintenance that is performed in Step S5. In the above, if da=NB, the controller 100 determines the second mode as the printing mode, but may determine the first mode as the printing mode.

Figure 14:
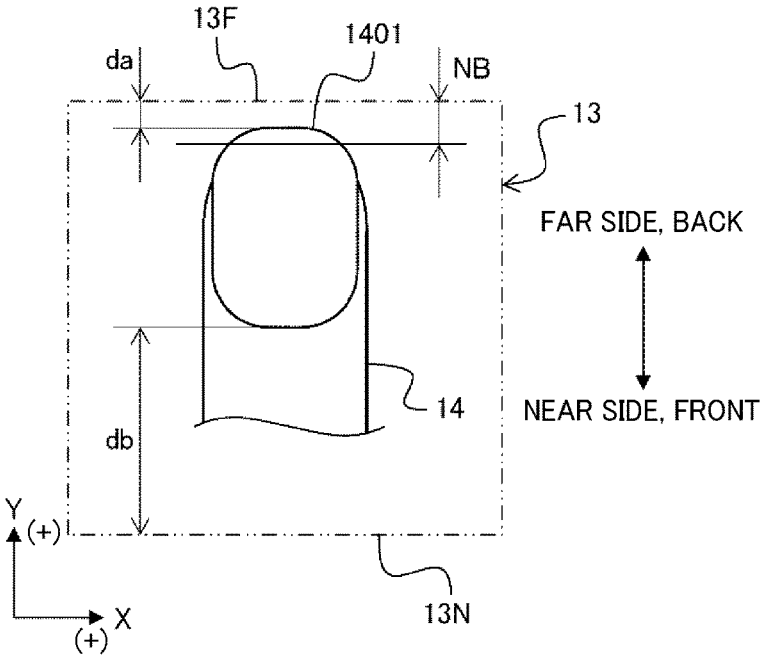
FIG. 14 is a diagram to explain an example of a method for determining a printing mode in accordance with the process shown in FIG. 13.

FIG. 14 is a diagram to explain an example of a method for determining the printing mode in accordance with the process shown in FIG. 13. The direction along the X-axis and the direction along the Y-axis in FIG. 14 coincide with the direction along the X-axis and the direction along the Y-axis in FIG. 5, respectively.

In the process shown in FIG. 13, the printer 1 determines whether or not the distance da from the far-side end 13F of the printable region 13 to the tip of the nail 1401 is equal to or longer than the block dimension NB of the nozzle group 701. As shown in FIG. 14, in this example, the distance da is shorter than the block dimension NB.

When the distance da is shorter than the block dimension NB, and the substantial printing region 12 is made to include the no-data region 11 behind the printing region 10, as described above with reference to FIG. 9, the far-side end of the substantial printing region 12 may be outside the printable region 13. That is, when da<NB and printing is performed in the second mode, the far-side end of the substantial printing region 12 may be outside the printable region 13. Hence, when da<NB, the printer 1 of this embodiment performs printing in the first mode. As described above, the first mode is the mode in which the printing start position is set such that a boundary between mutually adjacent blocks of the nozzle group 701 coincides with the far-side end 10F of the printing region 10. When the dimension SY of the printing region 10 in the direction along the Y-axis is not an integral multiple of the block dimension NB, and printing is performed in the first mode, the substantial printing region 12 includes the no-data region 11 in front of the printing region 10 as shown in, for example, FIG. 4.

In order to ease the restrictions on the treatable length of the finger 14 and so forth, a dimension of the printable region 13 in the direction along the Y-axis is about two to three times as long as the dimension of the nail 1401, which is an average nail as the printing target, thereby having an extra. When the distance da is shorter than the block dimension NB, as shown in FIG. 14, a distance db from the near-side end 13N of the printable region 13 to the root of the nail 1401 is longer than the block dimension NB of the nozzle group 701. Hence, when da<NB, selecting the first mode and allowing the substantial printing region 12 to include the no-data region 11 in front of the printing region 10 can prevent the amount of protrusion of the nozzle group 701 at each of the start and the end of printing from being large.

When da≥NB, the printer 1 performs printing in the second mode. As described above, the second mode is the mode in which the printing start position is set such that a boundary between mutually adjacent blocks of the nozzle group 701 coincides with the near-side end 10N of the printing region 10. When the dimension SY of the printing region 10 in the direction along the Y-axis is not an integral multiple of the block dimension NB, and printing is performed in the second mode, the substantial printing region 12 includes the no-data region 11 behind the printing region 10 as shown in, for example, FIG. 8.

When da≥NB, a magnitude relationship between (i) the distance db from the near-side end 13N of the printable region 13 to the root of the nail 1401 and (ii) the block dimension NB includes both db<NB and db≥NB. When db≥NB, regardless of whether printing is performed in the first mode or the second mode, the boundary between mutually adjacent blocks of the nozzle group 701 is not outside the printable region 13. Meanwhile, when db<NB and printing is performed in the first mode, the boundary between mutually adjacent blocks of the nozzle group 701 is outside the printable region 13. Hence, when db<NB, performing printing in the second mode can prevent the amount of protrusion of the nozzle group 701 from being large. Accordingly, when da≥NB, doing the above can prevent the amount of protrusion of the nozzle group 701 at each of the start and the end of printing from being large.

The mode determination process (Step S4) that is performed by the printer 1 of this embodiment is not limited to the process shown in FIG. 13, and may be another. For example, the mode determination process may be a process shown in FIG. 15.

Figure 15:
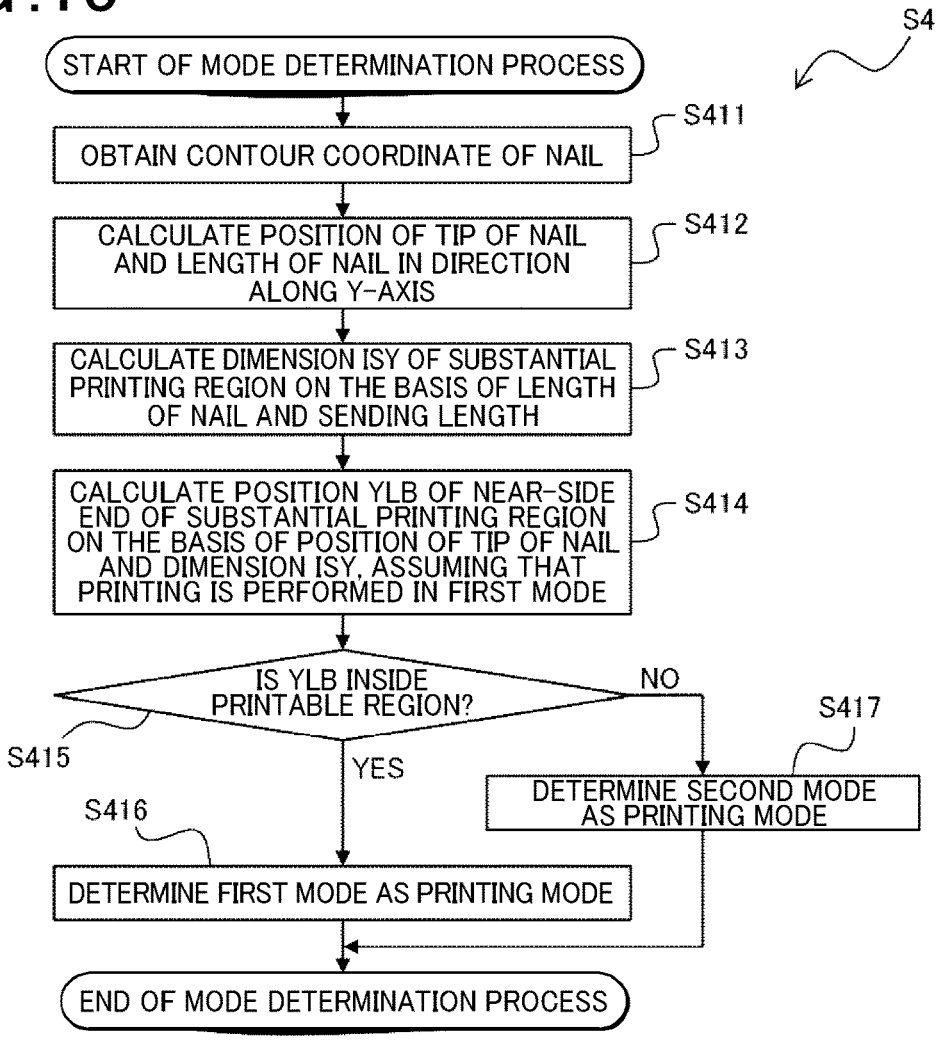
FIG. 15 is a flowchart to explain a second example of the mode determination process.

FIG. 15 is a flowchart to explain a second example of the mode determination process.

In the second example of the mode determination process, the controller 100 first obtains contour coordinates of the nail (Step S411). The controller 100 obtains contour coordinates of the nail included in the nail information generated by itself in Step S3.

Next, the controller 100 calculates a position of the tip of the nail and a length of the nail in the direction along the Y-axis (Step S412). In this example, on the basis of the contour coordinates of the nail, the controller 100 calculates coordinates of the backmost point of the contours in the direction along the Y-axis as the position of the tip of the nail. The controller 100 also calculates coordinates of the foremost point of the contours in the direction along the Y-axis as the position of the root of the nail, and calculates a distance from the tip to the root of the nail in the direction along the Y-axis as the length of the nail.

Next, the controller 100 calculates a printing dimension ISY on the basis of the length of the nail and a sending length (amount) in the direction along the Y-axis (Step S413). In this example, the controller 100 takes the block dimension NB of the nozzle group 701 as the sending length, and calculates, among integral multiples of the sending length, a length that is equal to or longer than the length of the nail, which has been calculated in Step S412, and is the shortest as the printing dimension ISY. The printing dimension ISY is, as shown in FIG. 4, the dimension of the substantial printing region 12 in the direction along the Y-axis.

Next, the controller 100 calculates a position YLB of the near-side end of the substantial printing region 12 on the basis of the position of the tip of the nail and the printing dimension ISY, assuming that singling (printing) is performed in the first mode (Step S414). When singling is performed in the first mode, a boundary between mutually adjacent blocks of the nozzle group 701 is made to coincide with the far-side end 10F of the printing region 10. Hence, a position in front of the far-side end 10F (i.e. in front of the tip of the nail) by the printing dimension ISY is the position YLB of the near-side end of the substantial printing region 12.

After calculating the position YLB, the controller 100 determines whether or not the calculated position YLB is inside the printable region 13 (Step S415). If the position YLB is inside the printable region 13 (Step S415; YES), the controller 100 determines the first mode as the printing mode (Step S416). If the position YLB is not inside the printable region 13, namely is in front of the near-side end 13N of the printable region 13 (Step S415; NO), the controller 100 determines the second mode as the printing mode (Step S417). After determining the printing mode in Step S416 or Step S417, the controller 100 ends the mode determination process.

When the position YLB, which has been calculated on the basis of the position of the tip of the nail and the printing dimension ISY being an integral multiple of the block dimension NB, is in front of the near-side end 13N of the printable region 13, as shown in FIG. 7, the boundary between mutually adjacent blocks of the nozzle group 701 is outside the printable region 13. In this case, contrary to the case described above with reference to FIG. 14, the distance da from the tip of the nail to the far-side end 13F of the printable region 13 is longer than the block dimension NB of the nozzle group 701. Hence, when the position YLB, which has been calculated in Step S414, is not inside the printable region 13, selecting the second mode and arranging the no-data region 11 of the substantial printing region 12 not in front of but behind the printing region 10 can prevent the amount of protrusion of the nozzle group 701 at each of the start and the end of printing from being large.

When the position YLB, which has been calculated in Step S414, is inside the printable region 13, the distance da from the tip of the nail to the far-side end 13F of the printable region 13 may be shorter than the block dimension NB of the nozzle group 701 (da<NB). Hence, when the position YLB is inside the printable region 13, selecting the first mode and arranging the no-data region 11 of the substantial printing region 12 not behind but in front of the printing region 10 can prevent the amount of protrusion of the nozzle group 701 at each of the start and the end of printing from being large.

As described above, the printer 1 of this embodiment can prevent the amount of the nozzle group 701 protruding from the printable region 13 at each of the start and the end of printing from being large. This can make the moving range of the print head 7 with respect to the printable region 13 small/short in the printer 1 employing the singling system, and accordingly can miniaturize the printer 1 and ease the restrictions on the treatable length of the finger 14 and so forth.

Although the programs are stored in the storage 160, they may be stored in, other than the abovementioned RAM and ROM, a removable storage medium, such as a USB flash memory, a CD (Compact Disc), or a DVD (Digital Versatile Disc).

The present invention is not limited to the above embodiments, and can be variously modified in the practical phase without departing from the scope of the present invention. Further, the embodiments may be appropriately combined and implemented. In this case, combined effects are obtained. Still further, the embodiments include various inventions that can be extracted by, from disclosed elements, selecting some of the disclosed elements and combining the same. For example, even if some elements are removed from all the elements disclosed in the embodiments, a configuration or structure made by removing the elements may be extracted as an invention as long as it can achieve at least one object and obtain at least one effect.

What is claimed is:

1. A printer comprising:

a print head that performs a first operation of ejecting ink from nozzles to a printing medium while moving in a first direction and a second operation of moving in a second direction intersecting with the first direction by a moving amount that is a block dimension in the second direction of each of blocks into which the nozzles are divided in the second direction; and a processor that, based on a position of the printing medium and the block dimension in the second direction, determines whether to perform printing on the printing medium in a first mode or a second mode, wherein the first mode is a mode in which a printing start position in the second direction of the print head is set such that a position in the second direction of one of boundaries between mutually adjacent blocks among the blocks coincides with a position of a back end of a printing region, and the second mode is a mode in which the printing start position of the print head is set such that a position of one of the boundaries coincides with a position of a front end of the printing region.

2. The printer according to claim 1, wherein the processor determines to perform the printing in the first mode in response to a distance from a back end of a printable region to a tip of the printing medium, the tip being positioned nearer to the back end of the printable region, being shorter than the block dimension in the second direction, and determines to perform the printing in the second mode in response to the distance being longer than the block dimension in the second direction.

3. A printer composing:

a print head that performs a first operation of ejecting ink from nozzles to a printing medium while moving in a first direction and a second operation of moving in a second direction intersecting with the first direction by a moving amount that is a block dimension in the second direction of each of blocks into which the nozzles are divided in the second direction; and a processor that, based on a position of the printing medium, a dimension of the printing medium in the second direction, and a printable region, determines whether to perform printing on the printing medium in a first mode or a second mode, wherein the first mode is a mode in which a printing start position in the second direction of the print head is set such that a position in the second direction of one of boundaries between mutually adjacent blocks among the blocks coincides with a position of a back end of a printing region, and the second mode is a mode in which the printing start position of the print head is set such that a position of one of the boundaries coincides with a position of a front end of the printing region.

4. The printer according to claim 3, wherein the processor determines to perform the printing in the first mode in response to the position of the front end of the printing region based on the position of the printing medium and the dimension of the printing medium in the second direction and based on an assumption that the printing is performed in the first mode being inside the printable region, and determines to perform the printing in the second mode in response to the position of the front end of the printing region being in front of the printable region.

5. A printing method comprising:

before causing a print head to perform a first operation of ejecting ink from nozzles to a printing medium while moving in a first direction and a second operation of moving in a second direction intersecting with the first direction by a moving amount that is a block dimension in the second direction of each of blocks into which the nozzles are divided in the second direction, based on a position of the printing medium and the block dimension in the second direction, determining whether to perform printing on the printing medium in a first mode or a second mode, wherein the first mode is a mode in which a printing start position in the second direction of the print head is set such that a position in the second direction of one of boundaries between mutually adjacent blocks among the blocks coincides with a position of a back end of a printing region, and the second mode is a mode in which the printing start position of the print head is set such that a position of one of the boundaries coincides with a position of a front end of the printing region.

6. A printing method comprising:

before causing a print head to perform a first operation of ejecting ink from nozzles to a printing medium while moving in a first direction and a second operation of moving in a second direction intersecting with the first direction by a moving amount that is a block dimension in the second direction of each of blocks into which the nozzles are divided in the second direction, based on a position of the printing medium, a dimension of the printing medium in the second direction, and a printable region, determining whether to perform printing on the printing medium in a first mode or a second mode, wherein the first mode is a mode in which a printing start position in the second direction of the print head is set such that a position in the second direction of one of boundaries between mutually adjacent blocks among the blocks coincides with a position of a back end of a printing region, and the second mode is a mode in which the printing start position of the print head is set such that a position of one of the boundaries coincides with a position of a front end of the printing region.

* * * * *